US006496586B1

(12) United States Patent
Hayes et al.

(10) Patent No.: US 6,496,586 B1
(45) Date of Patent: Dec. 17, 2002

(54) THIN LOUDSPEAKER

(75) Inventors: Michael A Hayes, Fulton, MD (US); John K. Conley, Glen Burnie, MD (US); Sean O'Brien, Greenbelt, MD (US); Michael J. Parrella, Weston, CT (US); David Claybaugh, Baltimore, MD (US); Thomas Lundie, St. Neots (GB); Zeev Kitov, Rockville, MD (US)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/209,234

(22) Filed: Dec. 10, 1998

Related U.S. Application Data

(60) Provisional application No. 60/070,686, filed on Jan. 7, 1998.

(51) Int. Cl.[7] ..... H04R 25/00

(52) U.S. Cl. ..... 381/152; 381/335

(58) Field of Search ..... 381/152, 431, 381/423, 173, 190, 182, 335; 310/324; 181/144, 199, 87, 145

(56) References Cited

U.S. PATENT DOCUMENTS 3,903,989 A * 9/1975 Bauer
4,792,978 A * 12/1988 Marquiss ..... 381/203
4,899,390 A * 2/1990 Takewa et al. ..... 381/154
5,031,222 A 7/1991 Takaya ..... 310/190
5,147,986 A * 9/1992 Cockrum et al.
5,196,755 A 3/1993 Shields ..... 310/324
5,374,124 A * 12/1994 Edwards ..... 381/90
6,215,884 B1 * 4/2001 Parrella et al. ..... 381/190

FOREIGN PATENT DOCUMENTS

JP 3-145899 * 6/1991

* cited by examiner

*Primary Examiner*—Sinh Tran
(74) *Attorney, Agent, or Firm*—Foley & Lardner

(57) ABSTRACT

A thin loudspeaker is provided that produces a superior frequency response and a diffuse acoustical pattern using magnetic drivers, acoustical plates, or a combination of magnetic drivers and acoustical plates. The invention contains a specially designed crossover network and a novel enclosure design. The novel enclosure includes a septum and cross bracing which enables the invention to realize superior performance in a thin loudspeaker design. The invention encompasses methods for improving the performance of an acoustical plate which include (1) placing acoustical plate motor elements on the plate in a manner that avoids rotational, mirror, and translational symmetry, (2) using acoustical plate motor elements of different shapes and sizes to stimulate the plate, and (3) using an acoustical plate that has an asymmetric shape. All of the embodiments of the invention may be covered with a decorative cover and hung on a wall like a picture or used to form a panel in a home entertainment center.

23 Claims, 14 Drawing Sheets

THIN LOUDSPEAKER

This application claims the benefit of U.S. Provisional Application No. 60/070,686 filed Jan. 7, 1998.

FIELD OF THE INVENTION

The present invention relates to thin loudspeakers, especially those that use multiple drivers to produce high fidelity sound.

BACKGROUND OF THE INVENTION

A great deal of research has gone toward developing thin loudspeakers. Thin loudspeakers are in demand because they are less intrusive than conventional loudspeakers and hence can be utilized in a greater variety of ways.

Over the years, the design of thin loudspeakers has evolved. Early thin loudspeakers included a relatively stiff and substantially planar diaphragm mounted in a frame and coupled at its rear surface to a speaker voice coil. The voice coil would press the rear surface of the diaphragm and cause sufficient vibration of the diaphragm to produce sound.

Later thin loudspeakers incorporated piezoelectric elements as the driving elements. One of the first piezoelectric thin loudspeakers consisted of a vibrating film stretched on a frame with a plurality of piezoelectric drivers attached directly to the film. Although the use of piezoelectric driver elements allowed the loudspeakers to become more compact, the frequency responses of such systems were poor.

In order to improve the frequency response of thin loudspeakers, designers began to use different drivers to reproduce different segments of the audible spectrum. For example, U.S. Pat. No. 5,031,222 entitled Piezoelectric Speaker issued to Takaya discloses a flat panel loudspeaker that utilizes at least two groups of piezoelectric drivers which have different primary resonance frequencies. The primary resonance frequency of one group of piezoelectric drivers has a value between the primary resonance frequency and secondary resonance frequency of the other group. Likewise, U.S. Pat. No. 5,196,755 entitled Piezoelectric Panel Speaker issued to Shields discloses a planar loudspeaker that utilizes an array of piezoelectric elements. By including individual elements in the array with different resonance frequencies, the band of frequencies that can be reproduced is increased.

Despite the advances made in the area of thin loudspeakers, conventional thin loudspeakers still have limitations. None of the patents described above or any other reference disclose a loudspeaker that can provide a superior frequency response in a thin structure.

SUMMARY OF THE INVENTION

The present invention provides a thin loudspeaker that produces a superior frequency response and a diffuse acoustical pattern using magnetic drivers, acoustical plates, or a combination of magnetic drivers and acoustical plates. The invention contains a specially designed crossover network and a novel enclosure design. The novel enclosure includes a septum and cross bracing which enables the invention to realize superior performance in a thin loudspeaker design. The invention encompasses methods for improving the performance of an acoustical plate which include (1) placing acoustical plate motor elements on the plate in a manner that avoids rotational, mirror, and translational symmetry, (2) using acoustical plate motor elements of different shapes and sizes to stimulate the plate, and (3) using an acoustical plate that has an asymmetric shape. All of the embodiments of the invention may be covered with a decorative cover and hung on a wall like a picture or used to form a panel in a home entertainment center.

In a preferred embodiment, a plurality of acoustical plate motor elements are attached to an L-shaped acoustical plate secured above at least a portion of the thin loudspeaker's septum. The acoustical plate motor elements are placed on the acoustical plate in a manner that avoids rotational, mirror, and translational symmetry. A magnetic driver is attached to the septum, and cross bracing connects the septum to the rear wall of the loudspeaker enclosure.

As pointed out in greater detail below, the present invention provides a thin loudspeaker that can reproduce high quality sound over a range of frequencies which was not previously possible in such a structure using a combination of magnetic drivers and acoustical plates.

It is an object of this invention to provide a thin loudspeaker that has the sensitivity of a conventional speaker and a diffuse acoustical radiation pattern.

It is another object of this invention to provide a thin loudspeaker that can efficiently provide a superior frequency response over the audible spectrum.

It is yet another object of this invention to create a thin loudspeaker that can provide superior acoustic performance utilizing either magnetic drivers, acoustical plates, or a combination of magnetic drivers and acoustical plates.

DESCRIPTION OF THE INVENTION

Figure 1:
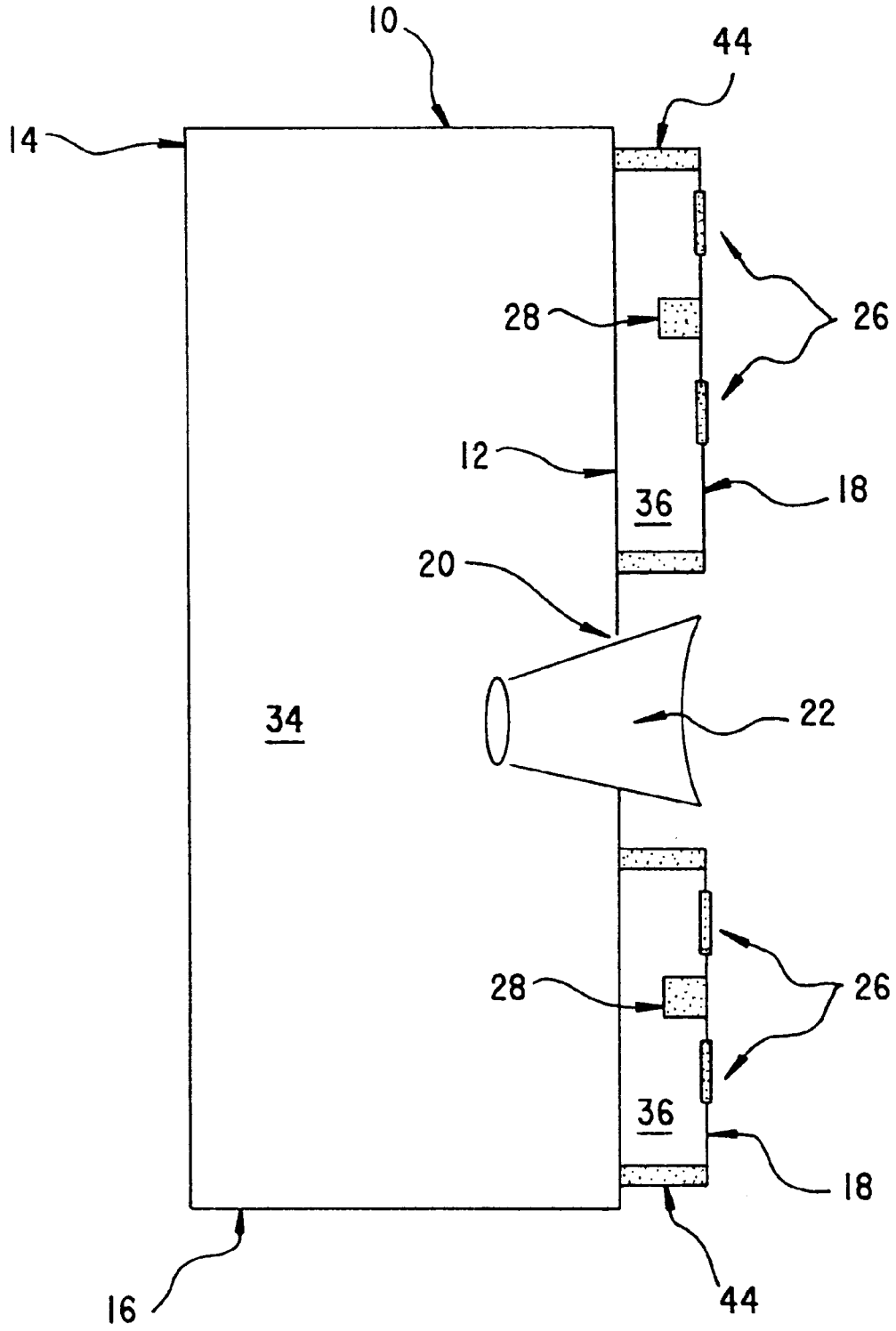
FIG. 1 is a cross-sectional view of a thin loudspeaker according to the present invention.
Figure 2:
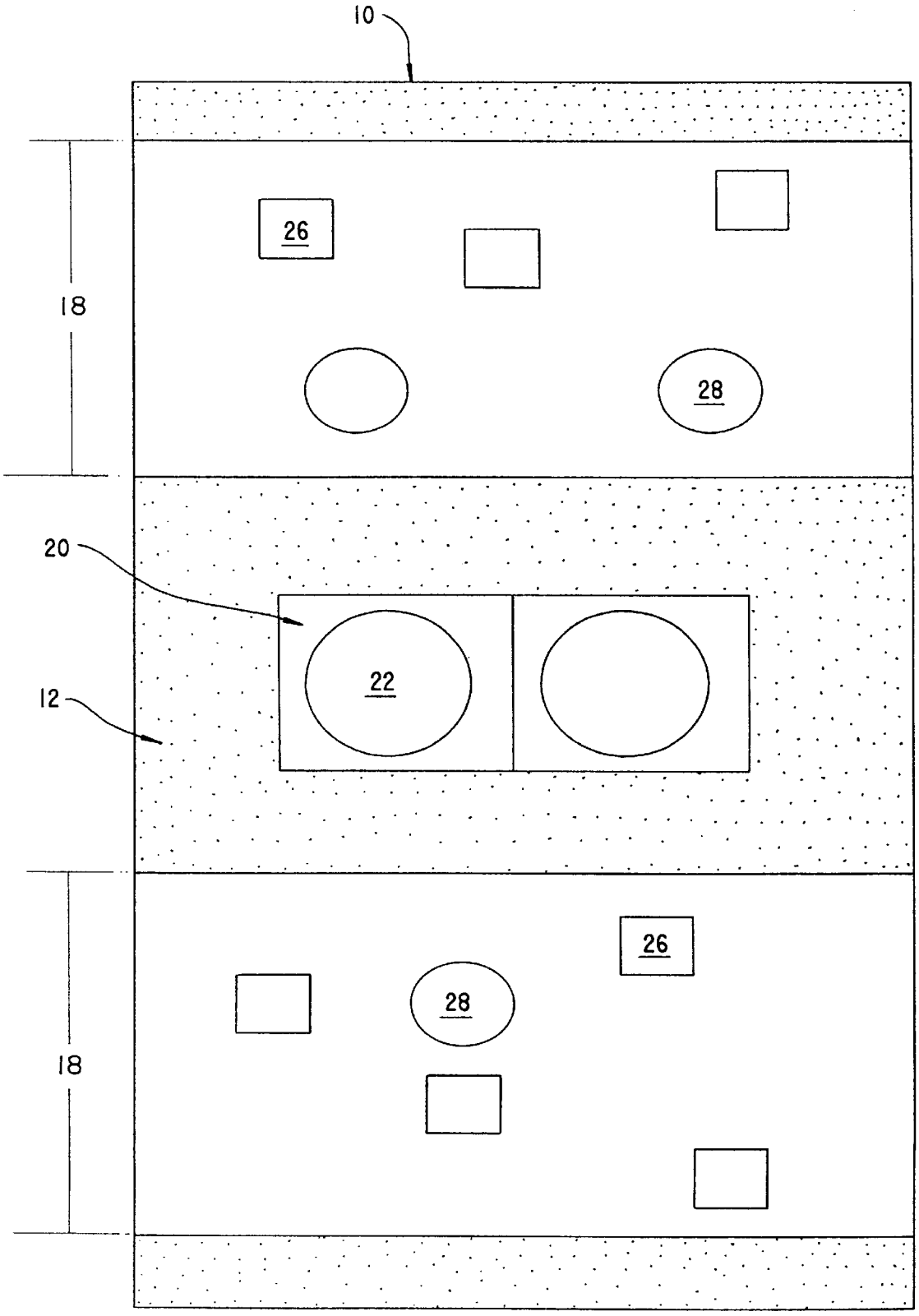
FIG. 2 is a front view of the thin loudspeaker of FIG. 1.

FIGS. 1 and 2 show one embodiment of the present invention. As shown in FIG. 1, the thin loudspeaker consists of an enclosure 10 having a rear wall 14 and side walls 16. The rear wall 14 and side walls 16 are constructed of tempered fiberboard, particle board, medium density fiberboard (MDF), or plastic.

A septum 12 is attached to the enclosure 10. As shown in FIG. 2, the septum 12 contains one or more openings 20. Each opening 20 is designed to accommodate a magnetic driver 22.

Figure 3:
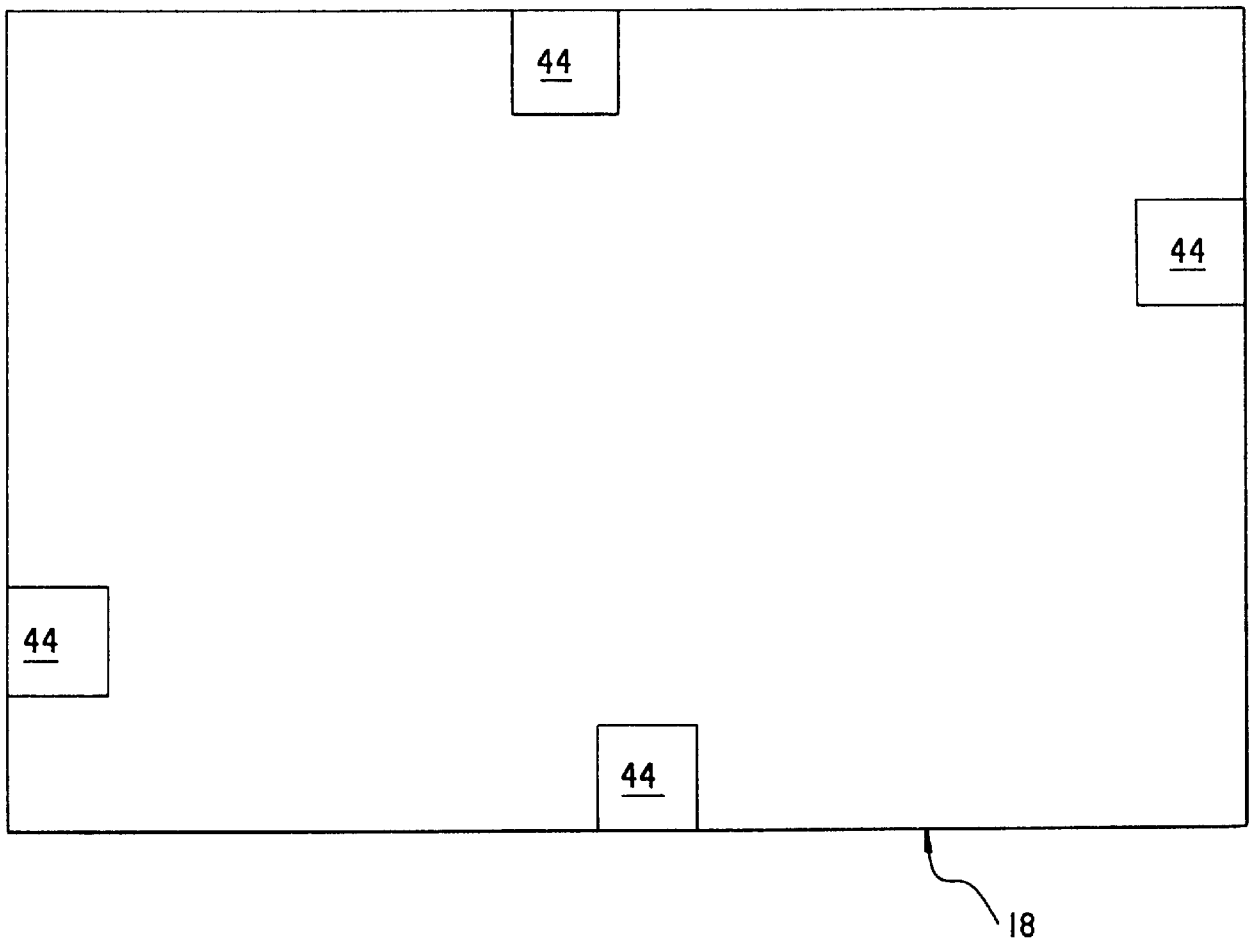
FIG. 3 illustrates an asymmetric arrangement of feet on a rectangular acoustical plate.
Figure 4:
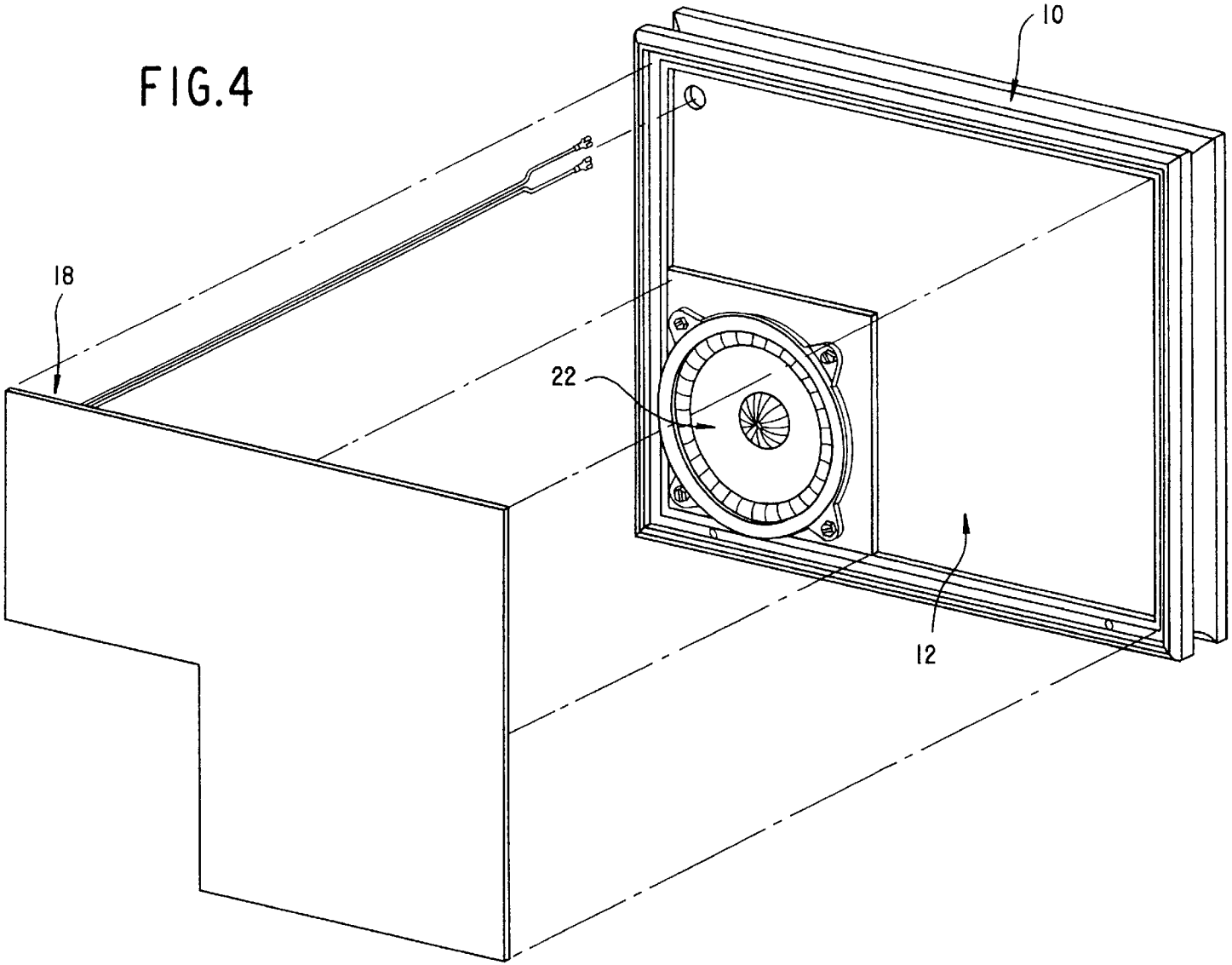
FIG. 4 is a front view of a thin loudspeaker according to the present invention that has one L-shaped acoustical plate secured to the edges of the loudspeaker enclosure.

One or more acoustical plates 18 are secured above at least a portion of the septum 12. Each acoustical plate(s) 18 is made of composite material consisting of a pair of epoxy fiberglass faces and a nomex honeycomb spacer, or other material having a high stiffness to weight ratio. As shown in FIG. 1, the acoustical plate(s) 18 can be secured above a portion of the septum 12 using feet 44 or other suspension means. The feet 44 or other suspension means should be placed asymmetrically on the acoustical plate(s) 18 to achieve optimal performance. FIG. 3 illustrates an asymmetric arrangement of feet 44 on a rectangular acoustical plate 18. As shown in FIG. 4, the acoustical plate 18 can be secured above a portion of the septum 12 by attaching it directly to the edges of the loudspeaker enclosure 10.

The dimensions of an acoustical plate 18 govern the frequency distribution of its resonant modes. Consequently, when multiple acoustical plates 18 are included in an embodiment of the invention, the dimensions of the plates 18 should be different. This helps to ensure a flat frequency response because the various plates 18 have different peaks in their frequency response curves. Similarly, using acoustical plates 18 constructed of different materials tends to flatten the frequency response of the invention.

A plurality of acoustical plate motor elements are attached to one or both sides of the acoustical plate(s) 18. The acoustical plate motor elements can consist of any combination of piezoelectric elements 26, magnetic motors 28, or other similar driving elements known to those skilled in the art. In FIGS. 1 and 2, both piezoelectric elements 26 and magnetic motors 28 are attached to the acoustical plates 18. Piezoelectric elements 26 make good motor elements because they can withstand very high drive voltages and produce very high sound levels without distortion or damage. If piezoelectric elements 26 are used as the acoustical plate motor elements, using piezoelectric elements 26 having different sizes, shapes, and/or compositions increases the randomness of the vibrational modes and hence improves the frequency response of the invention.

The acoustical plate motor elements are glued to the acoustical plate(s) 18 using cyanacrolates, epoxies, or other adhesives, or they are fabricated directly into the acoustical plate(s) 18 to create a more durable speaker. All of the acoustical plate motor elements are electrically coupled using conductive tape or other electrical connector known to those skilled in the art.

There is no limit on the number of acoustical plate motor elements that can be attached to any acoustical plate 18. Using a large number of acoustical plate motor elements reduces the peakiness (acoustical response to a swept sine wave input that is characterized by strong peaks and valleys) and brightness (spectral response that increases with increasing frequency) which can be exhibited by acoustical plates. Using a large number of acoustical plate motor elements also increases the overall sensitivity (ratio of the acoustical output to the drive voltage) of the invention.

Figure 5:
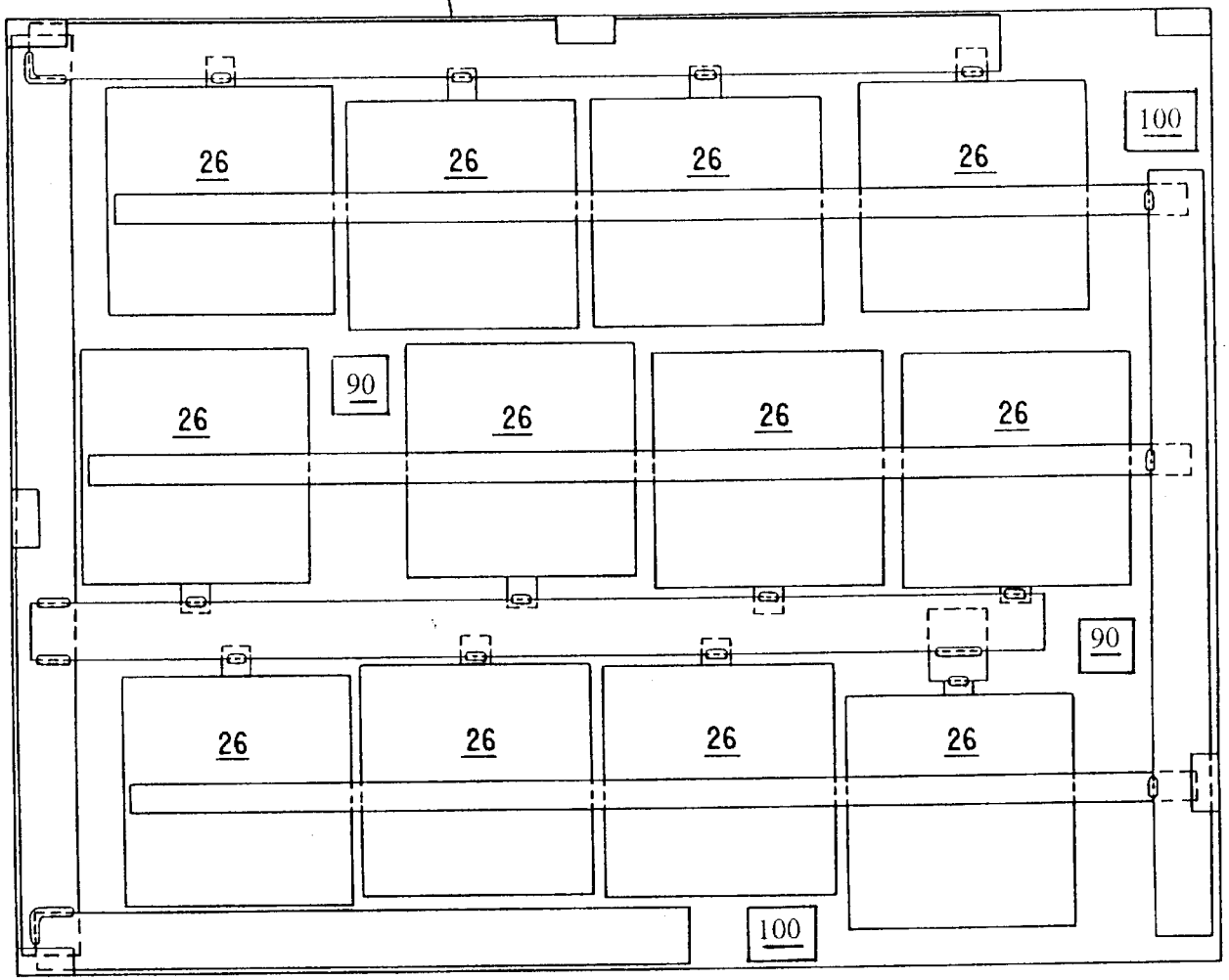
FIG. 5 shows an asymmetric arrangement of piezoelectric elements on a rectangular acoustical plate.

When the acoustical plate motor elements are arranged on the acoustical plate(s) 18, there should be as little symmetry as possible between respective elements. As shown in FIG. 5, piezoelectric elements 26 are placed on the acoustical plate(s) 18 in a manner that avoids rotational symmetry, mirror symmetry, and translational symmetry. If it is possible to flip an acoustical plate(s) 18 or rotate it about its center point and have one piezoelectric element 26 directly on top of another element 26, the optimal embodiment of the invention has not been realized. Mirror and rotational symmetry are undesirable because they give rise to modal degeneracy which tends to exacerbate peaks and valleys in the frequency response. Translational symmetry (periodicity) tends to drive up a set of harmonics for a given fundamental frequency—this is undesirable as it exacerbates brightness and peakiness.

Including different types of piezoelectric elements 26 on the same acoustical plate 18 can be used to introduce asymmetry. The piezoelectric elements 26 can differ in shape, size, thickness, metalization, or the type of material used. Including different types of piezoelectric elements 26 affects the frequency response of the acoustical plate 18.

Small masses 90 can also be attached to the acoustical plate 18 to introduce asymmetry. The masses 90 provide both localized mass addition and localized stiffness enhancement. The masses 90 can be similar in size, shape, and area density to the acoustical. plate motor elements on the acoustical plate 18.

Arranging the piezoelectric elements 26 in a non-symmetrical manner tends to ensure that the surface modes of the acoustical plate 18 with higher wave numbers are contributed to by different piezoelectric elements 26 in random phase. Conversely, the contributions of each piezoelectric element 26 to a low wave number (low frequency) surface mode of the acoustical plate 18 tend to be more nearly in phase since the phase difference between closely spaced motor elements is proportional to the wave number in the low wave number limit. When the surface modes of the acoustical plate 18 with higher wave numbers are contributed to by different piezoelectric elements 26 in random phase, the natural tendency of the acoustical plate 18 to exhibit increased sensitivity as the frequency rises is reduced.

Because each piezoelectric element 26 is attached to a location on the acoustical plate(s) 18 that bears little or no symmetry relationship to the locations of the other elements 26, the various piezoelectric elements 26 tend to produce peaks at different frequencies. The spectrum resulting from the sum of all of these different peaky spectra is much less peaky than any of the constituent spectra. This follows from the fact that the sum of N independent random samples varies as N, but the variation in the sum of N independent random samples varies as $N^{1/2}$. Therefore, the fractional variation in the sum of N independent random samples varies as $N^{-1/2}$.

The arrangement of the piezoelectric elements 26 on the acoustical plate(s) 18 is an important aspect of the invention. The arrangement of the piezoelectric elements 26 affects the distribution of resonant modes through the mechanism of mass distribution and the mechanism of localized stiffness enhancement. The arrangement of the piezoelectric elements 26 is also the principal determinant of the relative coupling strengths of the various resonant modes. The relationship between coupling strength and piezoelectric element 26 placement is complex, but generally piezoelectric elements 26 most effectively drive modes which exhibit plate stress to plate strain ratios at the location of the piezoelectric element 26 which are similar in magnitude to the ratio of the blocked force of the piezoelectric element 26 to the unconstrained displacement of the piezoelectric element 26 at a given applied potential. This condition can be described as an impedance match between the piezoelectric element 26 and the resonant mode. Thus, resonant modes which are impedance and phase matched to multiple piezoelectric elements 26 are expected to be the most strongly driven. Consequently, avoiding symmetries eliminates severe dropouts and peaks in the frequency response brought on by symmetry induced modal degeneracy.

The non-symmetrical arrangement of the acoustical plate motor elements enables several of the performance advantages of the invention to be achieved. First, the non-symmetrical arrangement results in a relatively flat overall frequency response because it allows the different plate motor elements to produce different and complimentary frequency responses. The total frequency response of all the elements is much flatter than the response of any single element. Second, the non-symmetrical arrangement compensates for the natural tendency of acoustical plate motor elements to exhibit increased sensitivity as the frequency rises over a significant portion of the audio spectrum. Third, it allows the acoustical response to avoid strong peaks and dropouts in the frequency response. Fourth, it enables the invention to have a sensitivity that is within the range of traditional loudspeakers.

Referring back to FIG. 1, one or more magnetic drivers 22 are attached to the septum 12. The magnetic driver(s) 22 are placed in the opening(s) 20 on the septum 12 and electrically coupled to an internal crossover network 50 which is discussed in further detail below. Using multiple magnetic drivers 22 enables the production of higher sound levels and more bass.

The magnetic driver(s) 22 and the acoustical plate(s) 18 have different back volumes. The back volume 36 of the acoustical plate(s) 18 may be opened or closed. Similarly, the back volume 34 of the magnetic driver(s) 22 can be ported or unported.

In a preferred embodiment of the present invention, pressure fluctuations within the back volume 34 of the magnetic driver(s) 22 are mechanically isolated from the back volume 36 of the acoustical plate(s) 18. Mechanically isolating the two back volumes 34, 36 prevents pressure fluctuations in the back volume 34 of the magnetic driver(s) 22 from deforming the acoustical plate(s) 18. Because of its dimensions, the thin loudspeaker of the invention is inherently much more susceptible to mechanical deformation and therefore to inadvertent acoustical radiation than traditional box-shaped loudspeaker enclosures. If the back volume 34 of the magnetic driver(s) 22 is not mechanically isolated from the back volume 36 of the acoustical plate(s) 18, there may be an undesirable variation of acoustical power with angle (resulting from interference between the magnetic driver 22 emissions and the secondary emissions from the acoustical plate 18).

Figure 6:
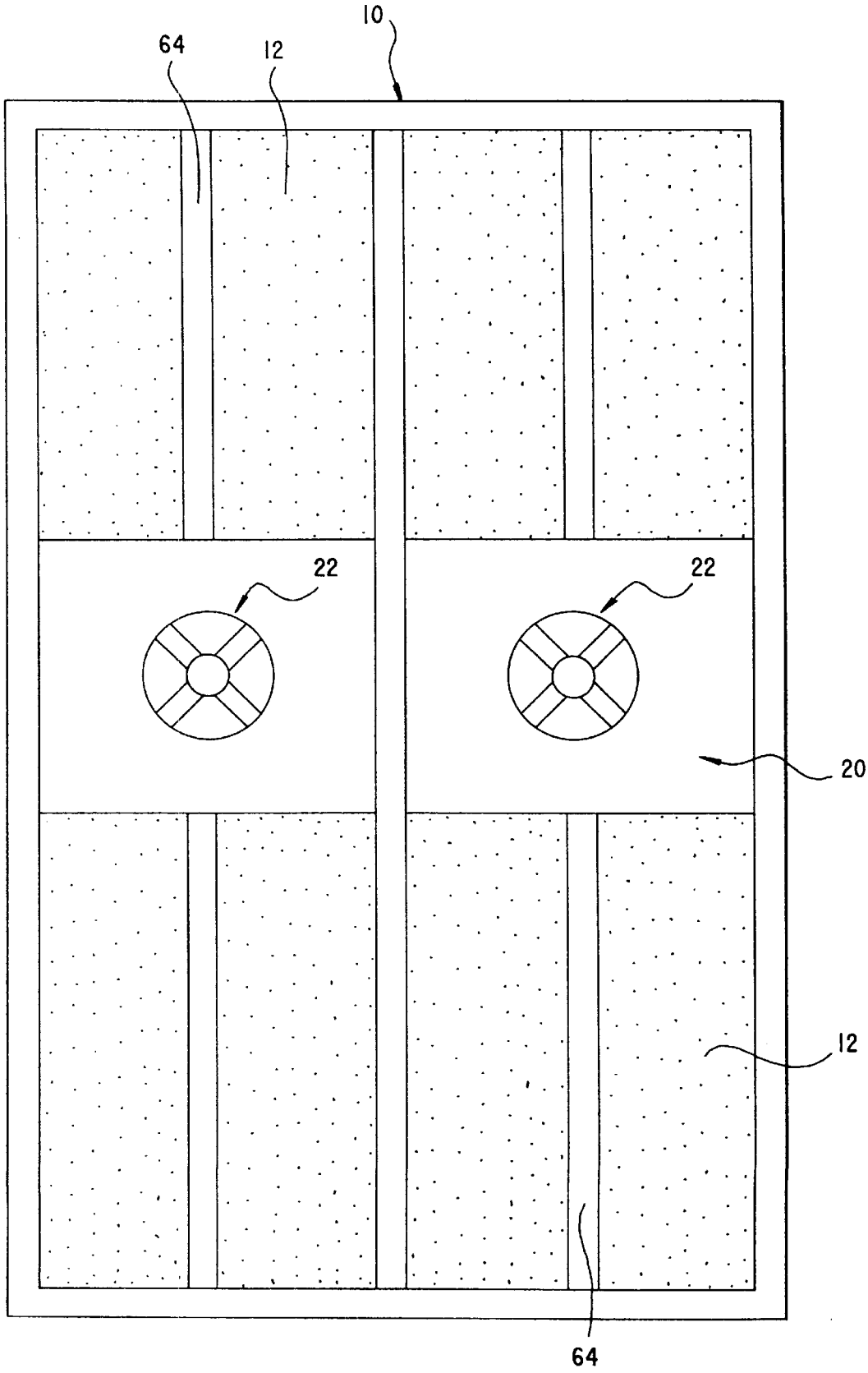
FIG. 6 is a rear view of one type of cross bracing arrangement used in the invention.

FIG. 6 shows one way of isolating the back volume 34 of the magnetic driver(s) 22 from the back volume 36 of the acoustical plate(s) 18. The septum 12 separates the back volume 34 of the magnetic driver(s) 22 from the back volume 36 of the acoustical plate(s) 18. Cross bracing 64 connects the septum 12 to the rear wall 14 of the loudspeaker enclosure.

The cross bracing 64 consists of a plurality of boards or other structural elements that span the magnetic driver back volume 34 and rigidly connect the septum 12 to the rear wall 14 of the loudspeaker enclosure at various locations. The board or structural elements that make up the cross bracing 64 can be made of tempered fiberboard, particle board, MDF, plastic, or other similar material. The cross bracing 64 dramatically increases the rigidity of the magnetic driver back volume 34 without significantly reducing the flow of air within the back volume 34. As a result of the cross bracing 64, unwanted secondary acoustic emissions from the enclosure 10 are reduced and the thin loudspeaker of the invention is able to achieve good acoustical dispersion characteristics.

The specific cross bracing arrangement 64 utilized in an embodiment of the invention greatly affects the performance of the invention. The arrangement of the cross bracing 64 is dictated by the location of the magnetic driver(s) 22 and must allow sufficient radial airflow from the magnetic driver(s) 22. In a preferred embodiment of the invention, the structural elements that make up the cross bracing 64 form multiple acoustical channels in the magnetic driver back volume 34. Because acoustical waves propagate back and forth along these channels, the invention produces a superior frequency response when the various channels are not symmetrical.

Thus, using acoustical channels of different lengths improves the frequency response of the invention. See FIG. 12 and FIG. 13. Because acoustical channels of different lengths have different resonant frequencies, constructive interference is minimized. In order to obtain the maximum number of acoustical channel lengths, the magnetic driver 22 should not be located in the middle of the loudspeaker enclosure 10.

Another way to improve the performance of the invention involves using a leakage path to connect the acoustical channels and ensuring each channel has a different expansion ratio. The expansion ratio is defined as the ratio of the separation between cross bracing 64 structural elements at the end of the channel furthest from the magnetic driver 22 to the separation between cross bracing 64 structural elements at the end of the channel closest to the magnetic driver 22. When each acoustical channel has a different expansion ratio, the pressure at the ends of the different channels is generally not equal. This is due to the different airflow profiles through the respective channels.

In a preferred embodiment, the leakage path is formed by terminating the cross bracing 64 just short of the walls of the speaker enclosure 10. Maintaining a leakage path that connects the outside ends of the channel tends to dampen strong standing waves within the magnetic driver back volume 34. Because the standing waves can alter the frequency response of the invention, the damping effect of the leakage path is very important.

Although the loudspeaker of the present invention has a thin profile, its performance equals or exceeds that of conventional loudspeakers because of the novel enclosure design incorporating cross bracing 64. Typically, secondary acoustic emissions are much worse in thin loudspeakers than they are in conventional loudspeakers. However, the cross bracing 64 greatly reduces unwanted secondary emissions in the present invention by coupling the rear wall of the enclosure to the front wall. Coupling the rear wall of the enclosure to the front wall allows the stress on the front wall to cancel the stress on the rear wall.

Figure 7:
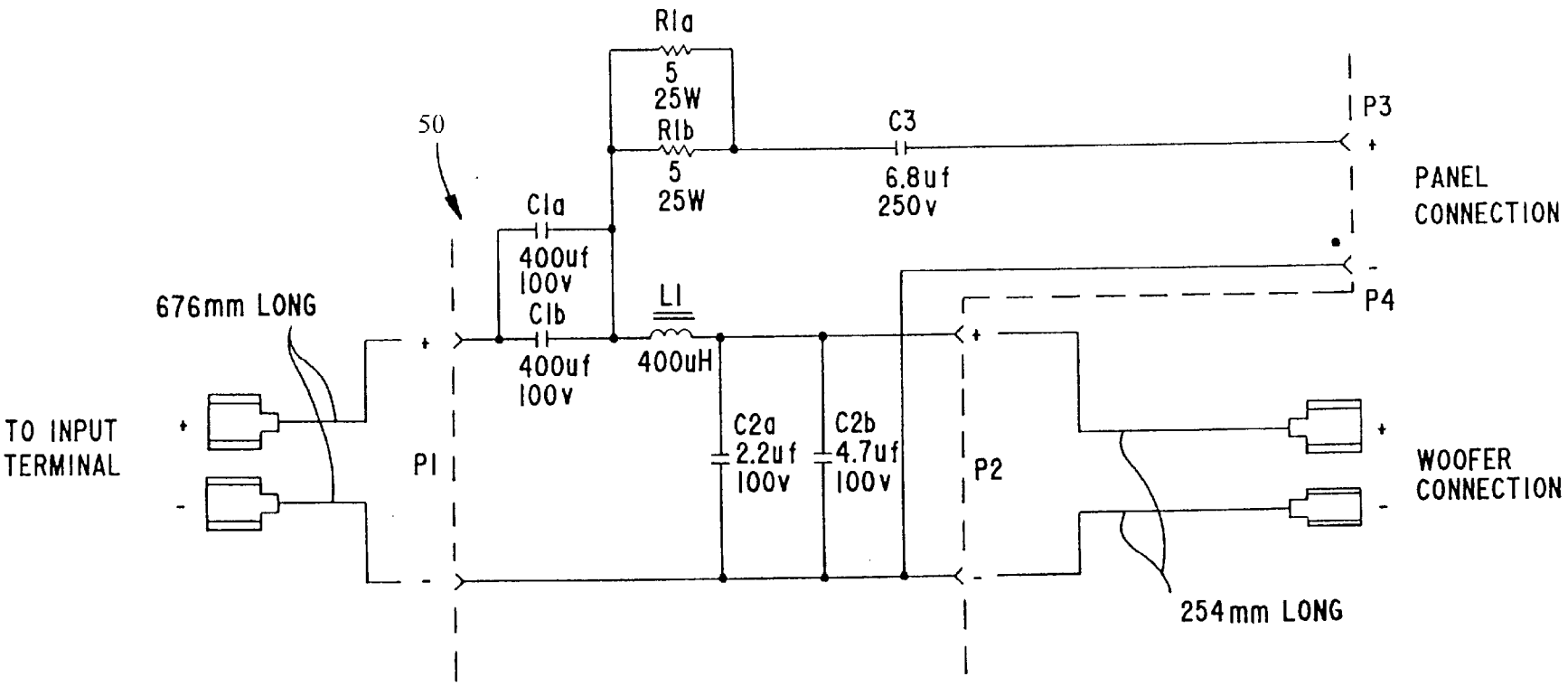
FIGS. 7, 8, and 9 illustrate crossover networks that can be utilized in the invention.
Figure 8:
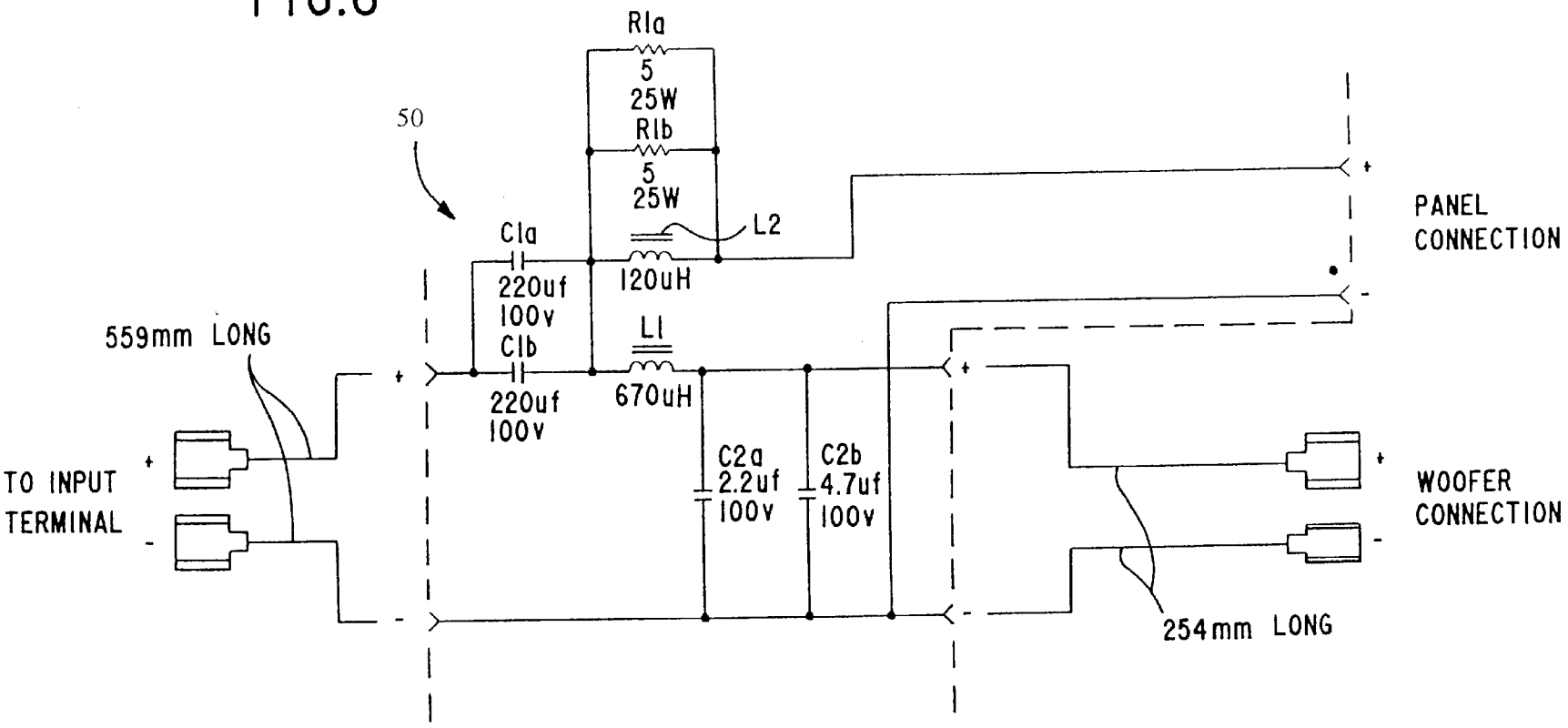
Figure 9:
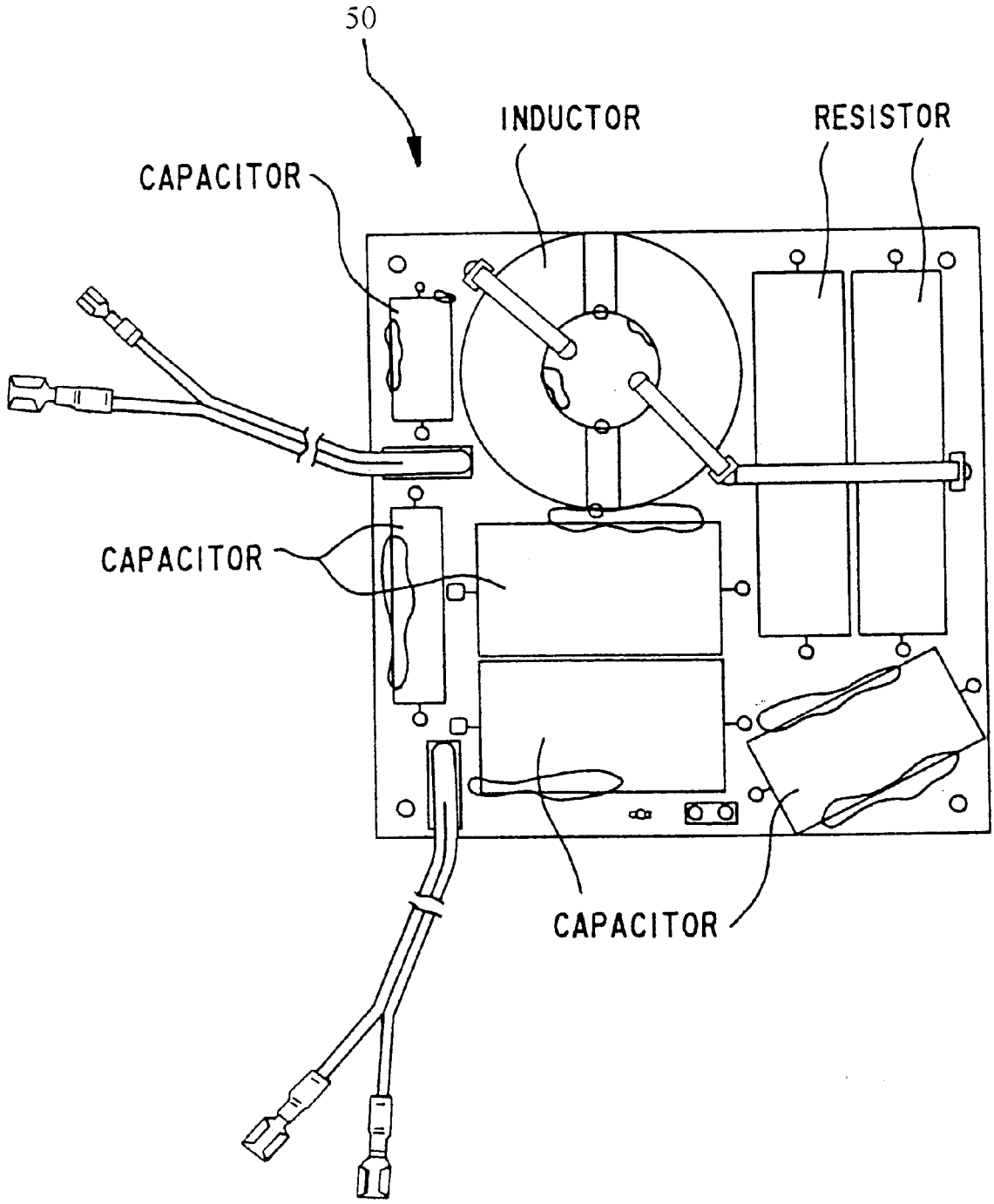

Embodiments of the invention that contain piezoelectric elements 26 ideally have a crossover network 50 like those shown in FIGS. 7, 8, and 9. The different electrical impedances of the piezoelectric elements 26 distinguish the crossover networks 50 of the invention from traditional speaker crossover networks. The crossover network 50 is electrically coupled to the magnetic driver(s) 22, the piezoelectric elements 26, and a terminal cup. The primary function of the crossover network 50 is to smoothly switch the acoustical output between the magnetic driver(s) 22 and acoustical plate(s) 18 to produce a full range of sound. The acoustical plate(s) 18, which is capable of reproducing a frequency as high as 20 kHz, is used to reproduce tweeter and midrange frequency sounds. The magnetic driver(s) 22 is utilized to reproduce low frequency sounds as low as 50 Hz.

Figure 10:
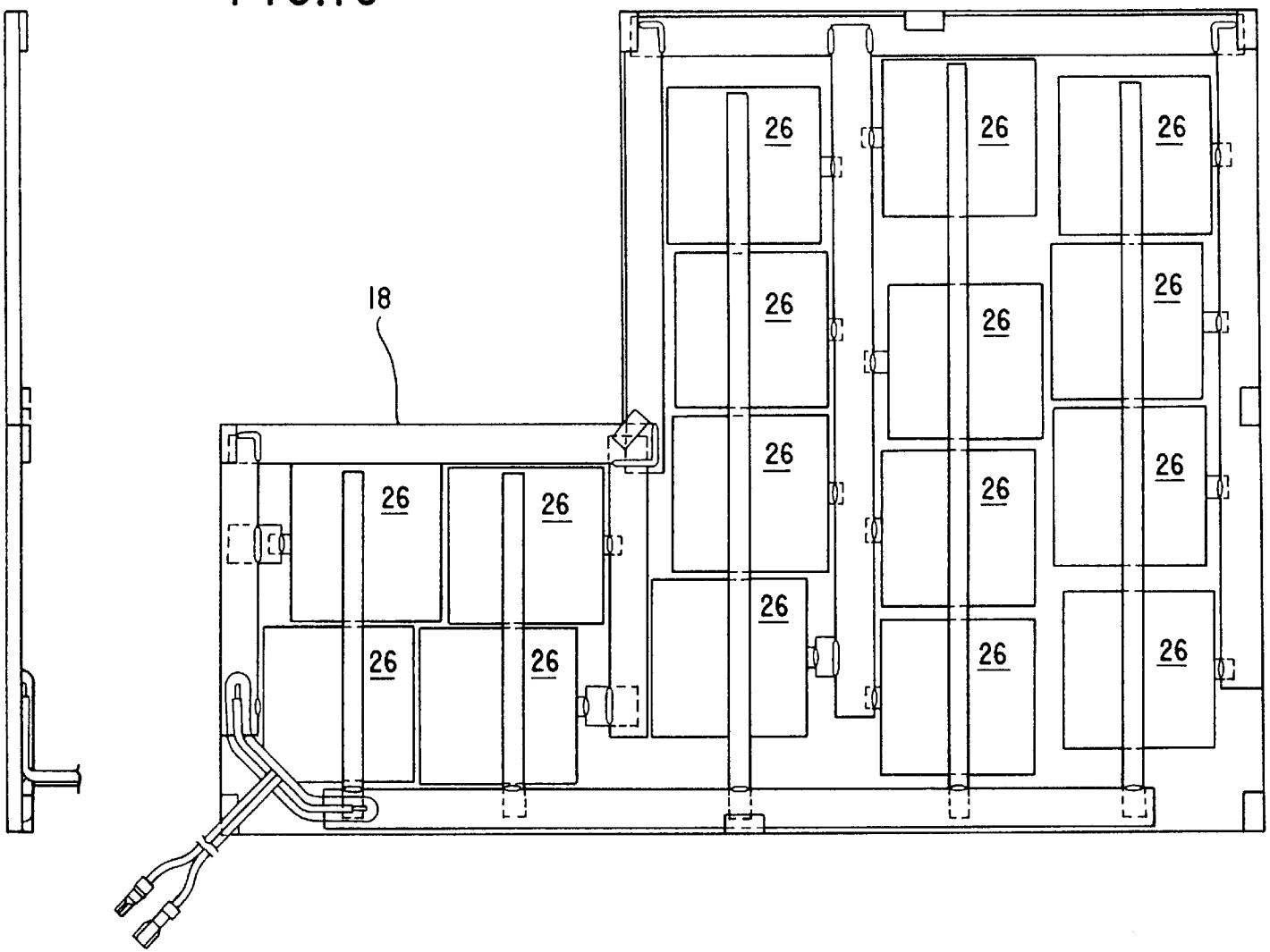
FIG. 10 shows an asymmetric arrangement of piezoelectric elements on an L-shaped acoustical plate.
Figure 11:
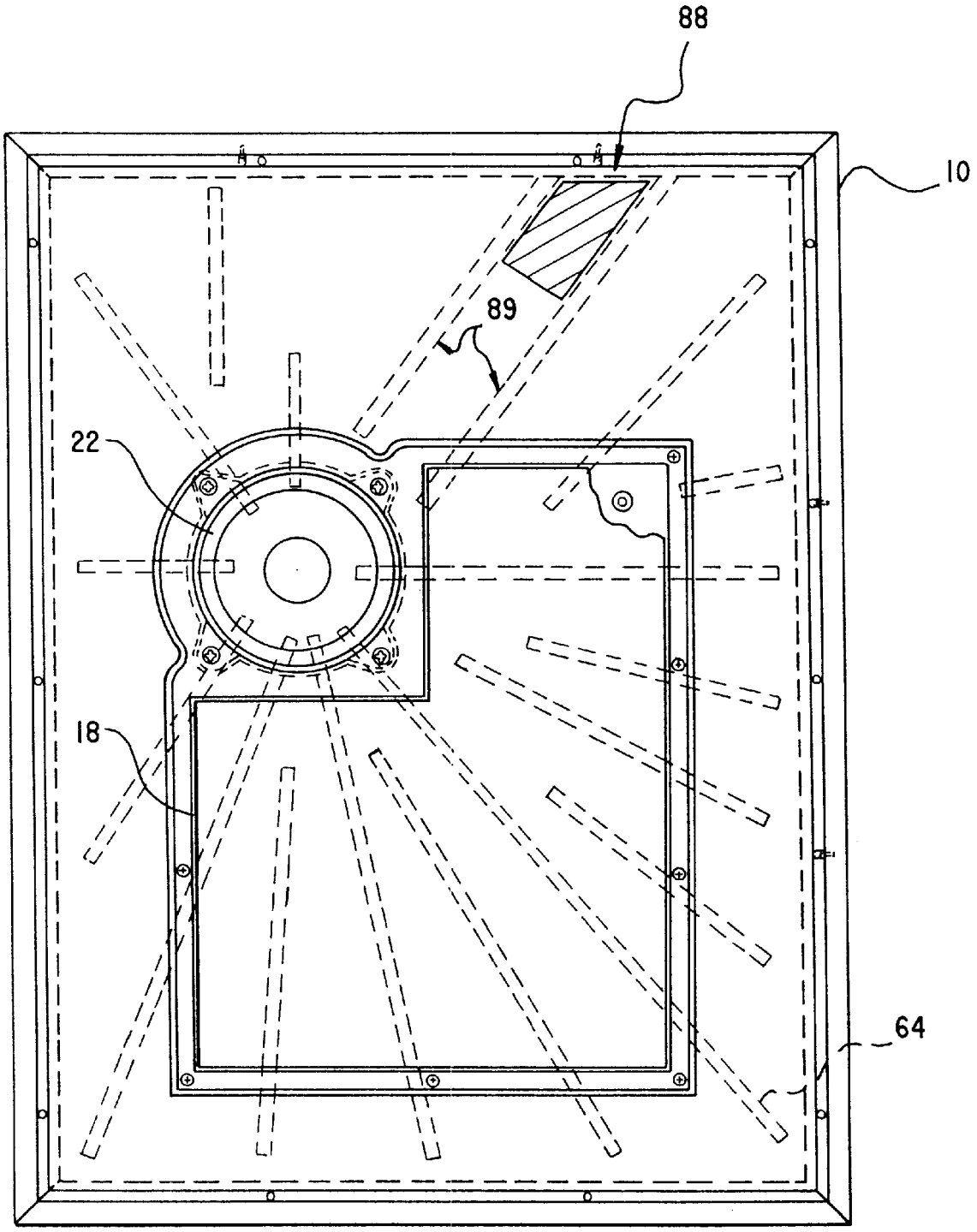
FIG. 11 is a front view of a thin loudspeaker according to the present invention that contains one L-shaped acoustical plate and one magnetic driver.

FIGS. 4 and 13 and FIGS. 11 and 12 show two different embodiments of a loudspeaker according to the present invention that contain one L-shaped acoustical plate. In both embodiments, a plurality of piezoelectric elements 26 are placed on the L-shaped acoustical plate 18 in a manner that avoids rotational symmetry, mirror symmetry, and, to the extent possible, translational symmetry as shown in FIG. 10. In both embodiments, the magnetic driver 22 is placed on the septum 12 in an area not occupied by the acoustical plate 18 as shown in FIG. 4 and FIG. 11.

Figure 12:
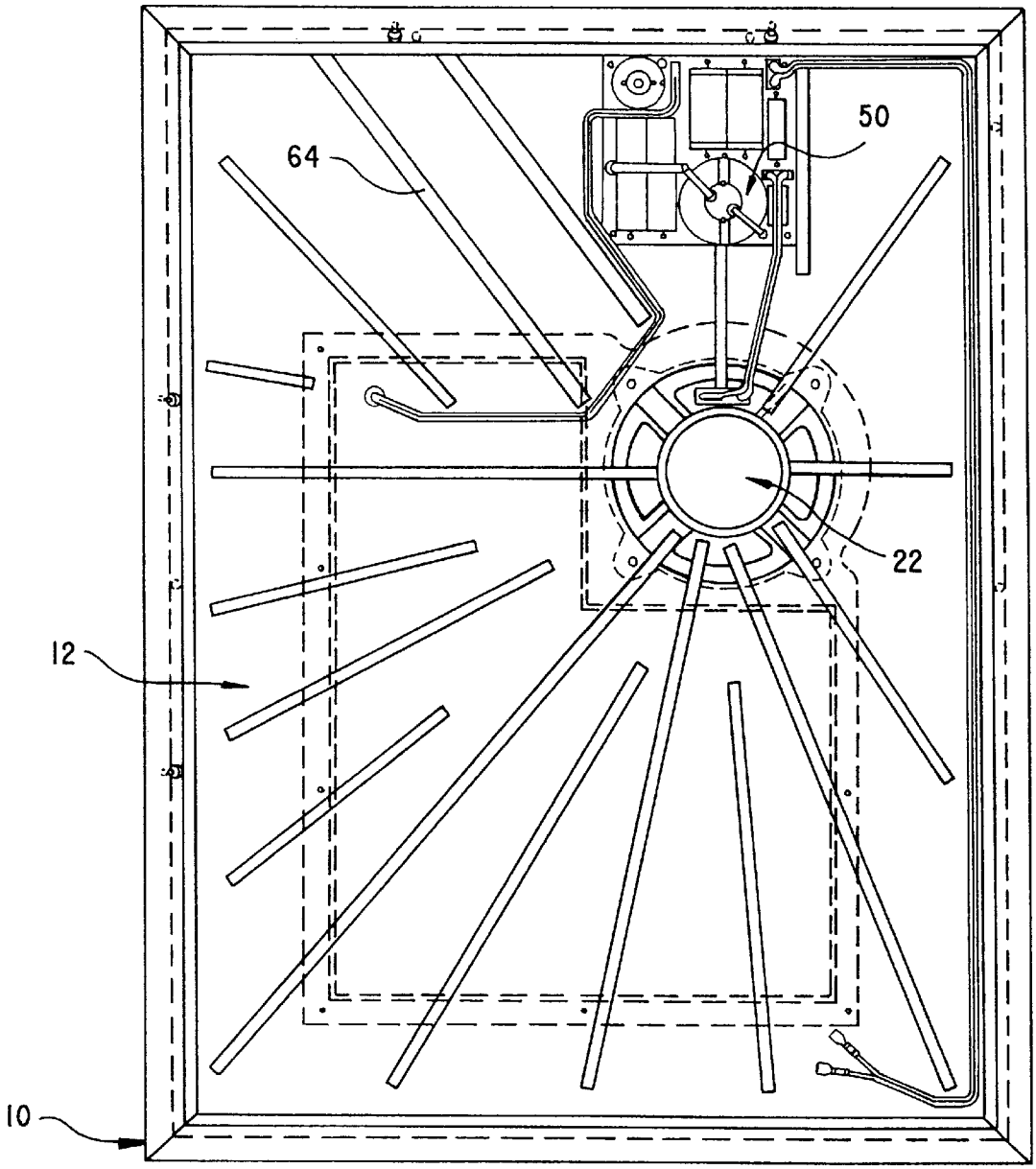
FIG. 12 shows a preferred cross bracing arrangement for the thin loudspeaker shown in FIG. 11.
Figure 13:
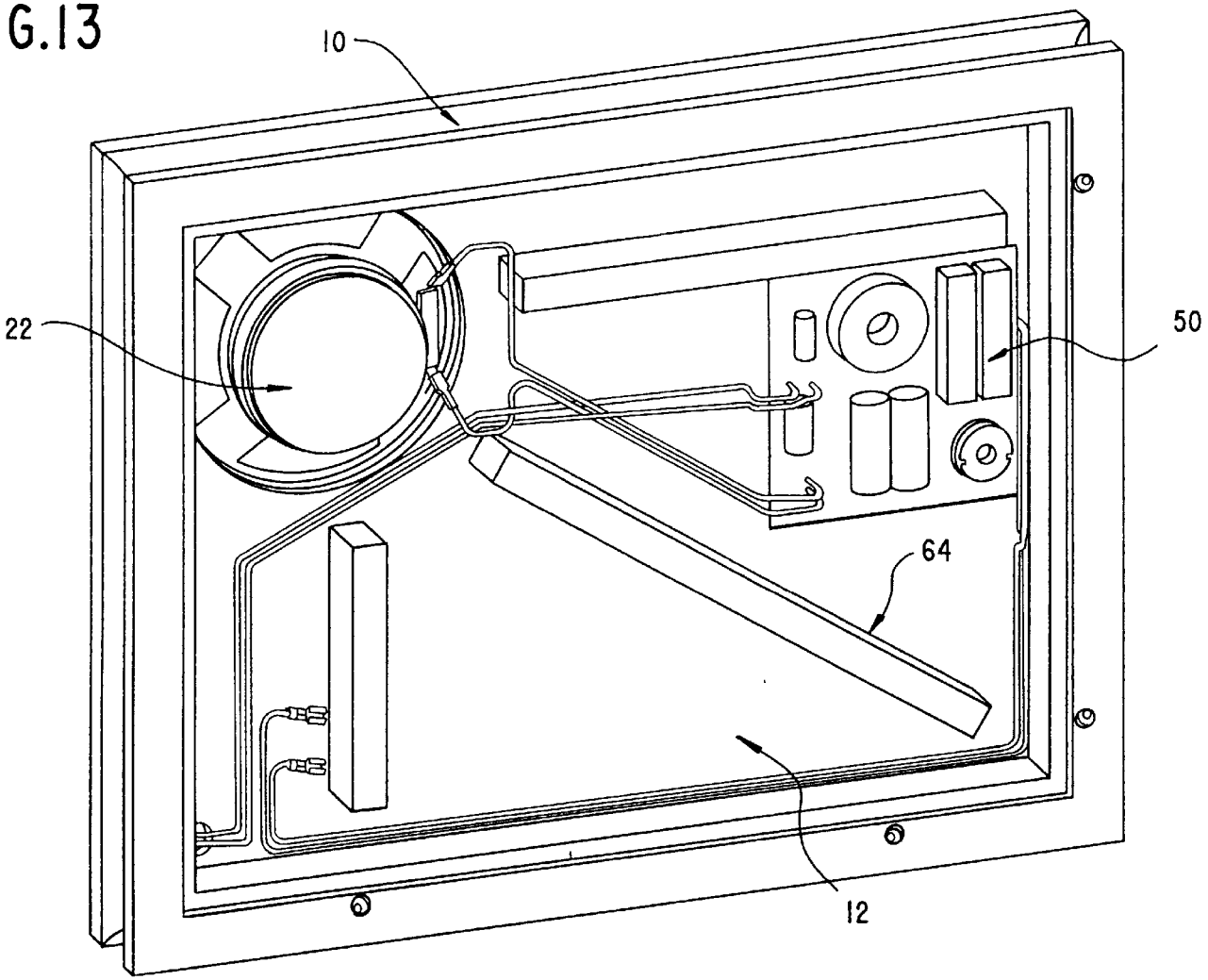
FIG. 13 shows a preferred cross bracing arrangement for the thin loudspeaker shown in FIG. 4.

FIG. 13 shows a cross bracing 64 arrangement that can be utilized in the embodiment shown in FIG. 4, and FIG. 12 shows a cross bracing 64 arrangement that can be utilized in the embodiment shown in FIG. 11. In both FIG. 12 and FIG. 13, the cross bracing 64 extends roughly radially from the magnetic driver 22 to near the side walls of the speaker enclosure 10.

Many variations of the disclosed invention are possible. In one variation, the side walls of the enclosure 10 can be lined with expanded polystyrene, polyurethane, or other foam approximately ½" thick to form a seal between the septum 12 and the side walls of the enclosure 10. The seal provides a predictable pattern of wave interference and reduces the time varying mechanical displacement of the enclosure 10.

Other variations of the invention can be achieved by modifying the back volumes of the loudspeaker. In one variation shown in FIG. 14, the back volume 34 of the magnetic driver(s) 22 includes an elastomeric membrane 110. At least a portion of one of the exterior walls making up the magnetic driver back volume 34 is coupled to an elastomeric membrane 110 before the loudspeaker is assembled. This assembly allows more bass to be produced.

In another variation, one or more of the back volumes includes a port. This variation is shown in FIG. 11. The port 88 is formed by cutting a hole in one of the exterior walls of the loudspeaker. The hole can be connected to a calibrated channel 89 built into the cross bracing 64. This variation of the invention has an enhanced bass response because of Helmholtz resonance.

Figure 14:
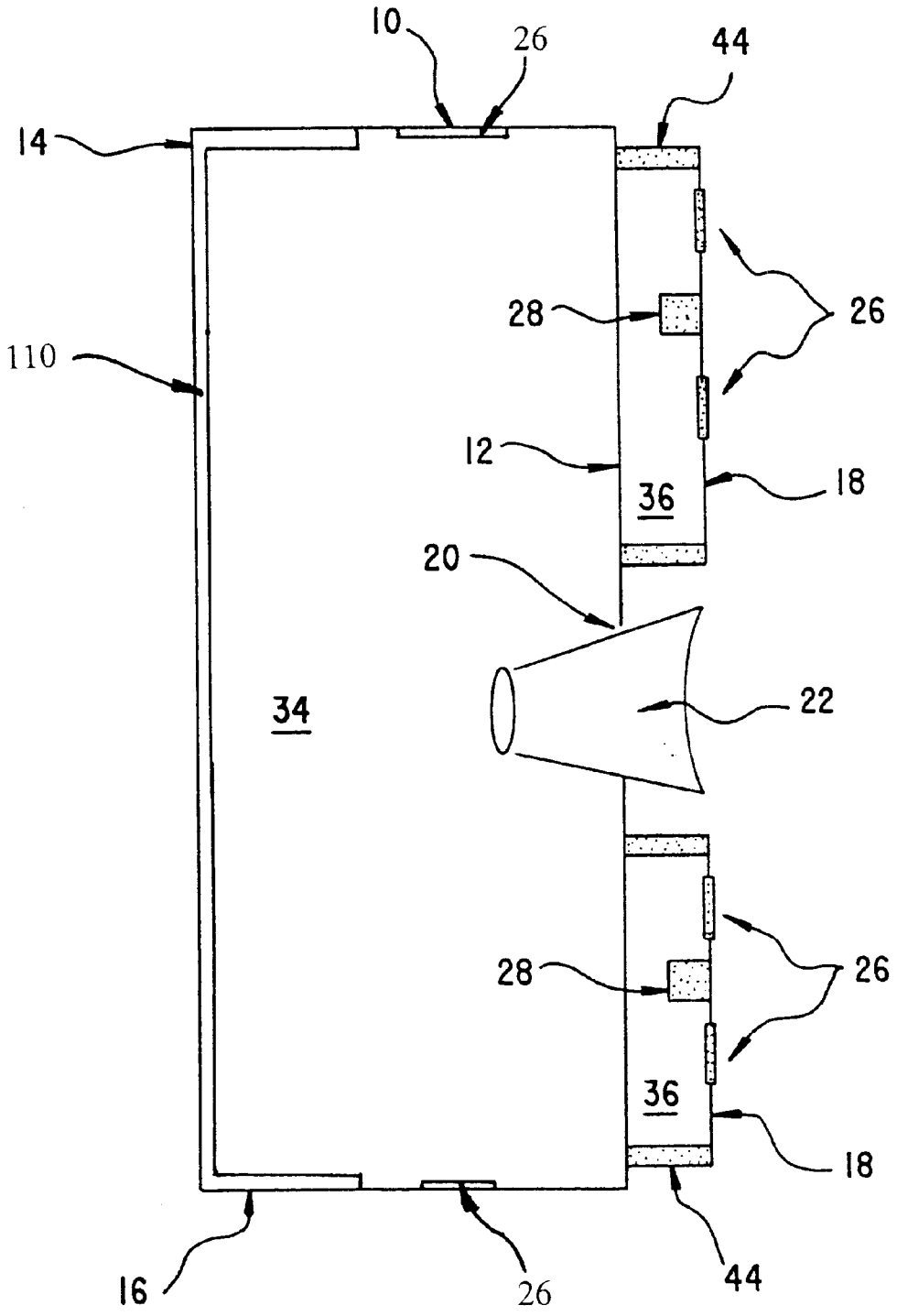
FIG. 14 shows a cross-sectional view of a thin loudspeaker according to an alternative embodiment of the present invention.

In still another variation shown in FIG. 14, one boundary of the magnetic driver back volume 34 has one or more piezoelectric elements 26 attached to it. The piezoelectric element(s) 26 is attached to one of the exterior walls of the back volume 34 before the loudspeaker is assembled. This embodiment increases the effectiveness of the back volume 34, thereby allowing more sound to be produced.

Under certain circumstances, it may be desirable to tune the frequency response of the acoustical plate(s) 18 because an unwanted resonance is present in the plate(s) 18. Several methods have been developed for fine tuning the frequency response of an acoustical plate 18. One method involves placing a solid support on the acoustical plate(s) 18 at points where the plate(s) is moving. Another option is to attach one or more damped resonant mechanical oscillators 100 to the plate(s) 18. The damped resonant mechanical oscillator(s) 100 should be attached at the antinode(s) of the resonances and tuned to the resonant frequencies.

Although the embodiments described in detail above contain both acoustical plates 18 and magnetic drivers 22, the invention also encompasses embodiments that contain only acoustical plates 18 or only magnetic drivers 22. The only differences between an embodiment containing only acoustical plates 18 and the embodiments described in detail above are there is no enclosure 10 and there are no openings 20 and no magnetic drivers 22. An embodiment containing only acoustical plates 18 is well suited for applications requiring only treble.

The only difference between an embodiment containing only magnetic drivers 22 and the embodiments described in detail above is there are no acoustical plates 18. If a cross over network is included, it is of the traditional variety. Embodiments containing only magnetic drivers 22 can employ bass and treble magnetic drivers or bass, midrange, and treble magnetic drivers. As in other embodiments of the present invention, the cross bracing 64 enables superior performance to be achieved in a flat speaker design.

Embodiments containing a plurality of the same type of magnetic drivers 22 can be driven in a special way to achieve wide-angle sound dispersion. To achieve wide-angle sound dispersion, the multiple magnetic driver elements 22 should be driven in-phase at low frequencies and increasingly out-of-phase as the frequency increases. The phase of the drivers 22 can be controlled by changing variables such as the spring constant of the spider, the spring constant of the surround, and/or the mass of the cone. Electrical components like inductors, capacitors, etc. and/or modifying the back volumes can also be used to vary the phase of the drivers 22. This technique can be used in any embodiment containing a plurality of the same type of magnetic drivers 22.

Because of the thin profile of a loudspeaker according to the present invention, it can be placed directly on a wall. A thin, dual conductive element applied to a portion of a wall can be used to supply audio signals to the speaker. The dual conductive element consists of two wide, thin conductors encased in separate but adjoining layers of insulation. Paper tape similar to that used to plaster wallboard covers the layers of insulation. The dual conductive element is applied to a wall using joint compound and subsequently painted or wallpapered over.

It should be understood that a wide range of changes and modifications can be made to the embodiments of the invention described above. Therefore, the foregoing detailed description should be regarded as illustrative rather than limiting. The following claims including all equivalents define the true scope of the invention.

What is claimed is:

1. A thin loudspeaker comprising:

an enclosure having a rear wall and side walls;

a septum containing one or more openings attached to said enclosure, said septum separates the acoustical plate back volume and the magnetic driver back volume;

one or more acoustical plates secured above at least a portion of said septum;

a plurality of acoustical plate motor elements attached to one or both sides of said acoustical plate(s); and one or more magnetic drivers placed in the opening(s) on said septum, where said acoustical plate motor elements are placed on said acoustical plate(s) in a manner that avoids rotational symmetry, mirror symmetry, and translational symmetry.

2. A thin loudspeaker comprising:

an enclosure having a rear wall and side walls;

a septum containing one or more openings attached to said enclosure, said septum separates the acoustical plate back volume and the magnetic driver back volume;

one or more acoustical plates secured above at least a portion of said septum;

a plurality of acoustical plate motor elements attached to one or both sides of said acoustical plate(s); and one or more magnetic drivers placed in the opening(s) on said septum, where said acoustical plate motor elements are piezoelectric elements having different sizes, shapes, thicknesses, metalizations, and/or compositions.

3. A thin loudspeaker comprising:

an enclosure having a rear wall and side walls;

a septum containing one or more openings attached to said enclosure, said septum separates the acoustical plate back volume and the magnetic driver back volume;

one or more acoustical plates secured above at least a portion of said septum;

a plurality of acoustical plate motor elements attached to one or both sides of said acoustical plate(s); and one or more magnetic drivers placed in the opening(s) on said septum, where feet are placed on said acoustical plates(s) and attached to said septum, and where the feet are placed asymmetrically on said acoustical plate (s).

4. A thin loudspeaker comprising:

an enclosure having a rear wall and side walls;

a septum containing one or more openings attached to said enclosure, said septum separates the acoustical plate back volume and the magnetic driver back volume;

one or more acoustical plates secured above at least a portion of said septum;

a plurality of acoustical plate motor elements attached to one or both sides of said acoustical plate(s); and one or more magnetic drivers placed in the opening(s) on said septum, where at least a portion of one of the walls making up the magnetic driver back volume is covered with an elastomeric membrane.

5. A thin loudspeaker comprising:

an enclosure having a rear wall and side walls;

a septum containing one or more openings attached to said enclosure, said septum separates the acoustical plate back volume and the magnetic driver back volume;

one or more acoustical plates secured above at least a portion of said septum;

a plurality of acoustical plate motor elements attached to one or both sides of said acoustical plate(s); and one or more magnetic drivers placed in the opening(s) on said septum, where one of the walls making up the magnetic driver back volume contains a piezoelectric element.

6. A thin loudspeaker comprising:

an enclosure having a rear wall and side walls;

a septum containing one or more openings attached to said enclosure, said septum separates the acoustical plate back volume and the magnetic driver back volume;

one or more acoustical plates secured above at least a portion of said septum;

a plurality of acoustical plate motor elements attached to one or both sides of said acoustical plate(s);

one or more magnetic drivers placed in the opening(s) on said septum; and cross bracing that connects said septum to the rear wall of the loudspeaker enclosure.

7. A thin loudspeaker according to claim 6 where said cross bracing comprises a plurality of boards arranged to allow sufficient radial airflow from said magnetic driver(s).

8. A thin loudspeaker according to claim 7 where a pair of cross bracing boards form a channel that connects to a port.

9. A thin loudspeaker according to claim 6 where said cross bracing forms multiple acoustical channels in the magnetic driver back volume that are connected by a leakage path.

10. A thin loudspeaker according to claim 9 where the leakage path is formed by terminating said cross bracing just short of the walls of said loudspeaker enclosure.

11. A thin loudspeaker according to claim 6 where said cross bracing forms multiple acoustical channels in the magnetic driver back volume that are different lengths.

12. A thin loudspeaker according to claim 6 where said cross bracing forms multiple acoustical channels in the magnetic driver back volume and each acoustical channel has a different expansion ratio which is defined as the ratio of the separation between cross bracing structural elements at the end of the channel furthest from the magnetic driver to the separation between cross bracing structural elements at the end of the channel closest to the magnetic driver.

13. A thin loudspeaker comprising:

an enclosure having a rear wall and side walls;

a septum containing one or more openings attached to said enclosure, said septum separates the acoustical plate back volume and the magnetic driver back volume;

one or more acoustical plates secured above at least a portion of said septum;

a plurality of acoustical plate motor elements attached to one or both sides of said acoustical plate(s);

one or more magnetic drivers placed in the opening(s) on said septum; and a crossover network electrically coupled to said plurality of acoustical plate motor elements, said magnetic drivers, and a terminal cup.

14. A method of fabricating a thin loudspeaker comprising the steps of:

forming an enclosure having a rear and side walls attaching a septum containing one or more openings to the enclosure, the septum separates the acoustical plate back volume and the magnetic driver back volume;

securing one or more acoustical plates above at least a portion of the septum;

attaching a plurality of acoustical plate motor elements to one or both sides of the acoustical plate(s) in a manner that avoids rotational, mirror, and translational symmetry; and inserting a magnetic driver in each opening on the septum.

15. A method according to claim 14 there securing one or more acoustical plates above the septum involves attaching feet to the acoustical plate and connecting the feet to the septum.

16. A method according to claim 15 where the feet are placed asymmetrically on the acoustical plate.

17. A method according to claim 14 where securing one or more acoustical plates above the septum involves attaching the acoustical plate directly to the edges of the loudspeaker enclosure.

18. A method according to claim 14 further comprising the step of arranging cross bracing within the back volume of the magnetic driver(s) so that it connects the septum and the rear wall of the loudspeaker enclosure.

19. A method according to claim 18 where arranging cross bracing within the back volume of the magnetic driver(s) forms multiple acoustical channels that are connected by a leakage path.

20. A method according to claim 19 where the leakage path is formed by terminating said cross bracing just short of the walls of said loudspeaker enclosure.

21. A method according to claim 18 where arranging cross bracing within the back volume of the magnetic driver(s) forms multiple acoustical channels that are different lengths.

22. A method according to claim 18 where arranging cross bracing within the back volume of the magnetic driver(s) forms multiple acoustical channels and each acoustical channel has a different expansion ratio which is defined as the ratio of the separation between cross bracing structural elements at the end of the channel furthest from the magnetic driver to the separation between cross bracing structural elements at the end of the channel closest to the magnetic driver.

23. A method according to claim 14 further comprising the step of coupling the acoustical plate motor elements and magnetic drivers to a crossover network which is coupled to a terminal cup.

* * * * *